US008636475B2

(12) United States Patent
Masserey et al.

(10) Patent No.: US 8,636,475 B2
(45) Date of Patent: Jan. 28, 2014

(54) TURBOMACHINE, ESPECIALLY STEAM TURBINE

(75) Inventors: Pierre-Alain Masserey, Wuerenlos (CH); Rolf Hunziker, Dintikon (CH); Benedikt Wanner, Fislisbach (CH); Christoph Gerber, Rheinfelden (CH)

(73) Assignee: Alstom Technology Ltd, Baden (CH)

( * ) Notice: Subject to any disclaimer, the term of this patent is extended or adjusted under 35 U.S.C. 154(b) by 1022 days.

(21) Appl. No.: 12/627,514

(22) Filed: Nov. 30, 2009

(65) Prior Publication Data

US 2010/0135775 A1 Jun. 3, 2010

(30) Foreign Application Priority Data

Dec. 1, 2008 (DE) ..... 10 2008 059 836

(51) Int. Cl.
*F01D 5/22* (2006.01)

(52) U.S. Cl.
USPC ..... 416/196 R

(58) Field of Classification Search
USPC ..... 416/189, 190, 194, 195, 196 R
See application file for complete search history.

(56) References Cited

U.S. PATENT DOCUMENTS

| | | | | |
|---|---|---|---|---|
| 3,728,044 | A | 4/1973 | Fujita et al. | |
| 3,778,190 | A | 12/1973 | Ouellette | |
| 4,257,743 | A | 3/1981 | Fujii | |
| 4,401,411 | A | 8/1983 | Hisano et al. | |
| 4,407,634 | A | 10/1983 | Tones | |
| 7,165,943 | B2 * | 1/2007 | Suzuki et al. | 416/190 |

FOREIGN PATENT DOCUMENTS

| | | | |
|---|---|---|---|
| CN | 1534166 | A | 10/2004 |
| CN | 101285404 | A | 10/2008 |
| DE | 2246134 | A1 | 4/1973 |
| JP | 10176501 | A | 6/1998 |
| JP | 11013401 | A | 1/1999 |

OTHER PUBLICATIONS

Chinese Patent Office First Office Action for Application No. 2009102584019.2 dated Jun. 5, 2013.

* cited by examiner

*Primary Examiner* — Dwayne J White

(74) *Attorney, Agent, or Firm* — Buchanan Ingersoll & Rooney PC

(57) ABSTRACT

A turbomachine includes a turbine stage having a plurality of blades including a first and a second blade disposed adjacent to each other, each blade having a radial longitudinal axis and a blade tip and configured to twist around the radial longitudinal axis in an operating state in a twist direction, wherein the first and the second blades are pretwisted in a direction of twist in a non-operating state, and wherein a connecting element interconnects the first and the second blades to each other in a circumferential direction in a region of the respective blade tip so as to maintain the pretwisting.

19 Claims, 2 Drawing Sheets

TURBOMACHINE, ESPECIALLY STEAM TURBINE

Priority is claimed to German Application No. DE 10 2008 059 836.4, filed Dec. 1, 2008, the entire disclosure of which is incorporated by reference herein.

The present invention refers to a turbomachine, especially a steam turbine, which has a turbine stage with a plurality of blades. The invention also refers to a method for producing a connection of two adjacent blades of a turbine stage of a turbomachine.

BACKGROUND

Turbine stages, especially end stages, of conventional turbomachines are constructed in either an unshrouded or coupled manner. In this case, for vibration damping either a direct coupling between the individual turbine blades without an additional friction element, or an indirect coupling via a friction element, is possible.

In the case of a direct coupling, there is customarily a direct contact between adjacent blades, support wing connections and cover plate connections for example coming within this category. A direct coupling on the one hand leads to considerable stiffening of a blade ring and in most cases to low mistuning effects, while on the other hand only small damping effects can be achieved with the direct coupling.

All connecting elements, which lead only to a negligible coupling or to a negligible stiffening of the blade ring, are subsumed under an indirect coupling.

In the case of customary connecting concepts, which are used at present, for long turbine blades, especially in the case of long end-stage blades, a more or less direct coupling takes place. The disadvantages of a directly coupled connecting system, as mentioned in the introduction, lie in the damping behavior since the direct coupling during operation limits the relative movements between the blades and as a result less energy can be dissipated via friction damping. A further problem exists in the fact that long end-stage blades experience severe twisting when running up, as a result of which large displacements at the blade tip occur, which can lead to problems with the fastening of the connecting elements.

A connecting element for connecting two turbine blades at their blade tip is known from U.S. Pat. No. 4,401,411. For this, the turbine blades have in each case a cover plate which is arranged essentially at a right angle to the longitudinal extent of the blade and is provided with a through-hole which extends essentially parallel to the longitudinal direction of the blade. The connecting element has a pin which is formed complementary to this hole and with which the connecting element engages in the hole when connecting two adjacent turbine blades. The connecting element in this case is both to have a damping effect and to reduce twisting of the turbine blades around their blade longitudinal axis during operation of the turbine.

A coupling element for connecting two adjacent turbine blades is known from U.S. Pat. No. 4,257,743, wherein each coupling element has an essentially hemispherical negative recess in which the coupling element of the adjacent turbine blade engages with a hemispherical positive forming which is formed complementary to it.

Similar connecting elements for adjacent turbine blades are known from JP 11 01 3401 and JP 10 17 6501. The connecting elements which are known from these have a locking contour or mating locking contour formed complementary to it which are arranged in each case on a sealing element on a blade tip of the respective turbine blade. The sealing element therefore has a locking contour for one adjacent turbine blade, while it has a mating locking contour for the other adjacent turbine blade so that the sealing elements, which are essentially formed constructionally the same, of the turbine blades engage in each other without any problem.

SUMMARY OF THE INVENTION

An aspect of the present invention is to provide an improved turbomachine in which the individual turbine blades are coupled to each other at their blade tip via indirect connecting elements especially so that twisting of the turbine blades, which occurs when running up the turbomachine, can also be absorbed.

The invention is based on the general idea of anticipating a possible twisting of the turbine blades around their radial longitudinal axis before the installation of connecting elements, which couple two adjacent blades to each other in each case in the circumferential direction in the region of their blade tip, by the blades in the non-operating state being already pretwisted in their direction of twist and by these being fixed in this pretwisted position via the connecting elements. When being installed, the blades are therefore already pretwisted by a specific angle and held in this position or supported against each other by means of the connecting element. When running up the turbomachine, the pretensioning first of all is reduced and the overall twist difference between the non-operating state and the operating state turns out to be significantly less than without pretwisting since at least some of the twisting which occurs is already anticipated as a result of the pretwisting. As a result of this, the effect is achieved of the connecting element being exposed only to some of the twisting which was not already compensated by means of the pretwisting. This leads to a reduction of the twisting which occurs overall and as a result leads to an improved coupling or connection between the individual turbine blades which are indirectly coupled to each other via the connecting element.

According to an advantageous embodiment of the solution according to the invention, each connecting element has a coupling element which is arranged between two adjacent blades in an overlapping region of these. The coupling element therefore serves as a buffer between two blades which overlap in the circumferential direction and brings about an indirect coupling of these. In this case, one blade abuts on the one side of the coupling element, while the adjacent other blade abuts on the other side of the coupling element. The arranging of the two blades on the respective side of the coupling element is carried out in this case under tension so that the coupling element is clamped between the two adjacent turbine blades, at least in the non-operating state. The tension which is transmitted by the blades results from their elastic pretwisting. When running up the turbine, that is to say as speed increases, the twisting forces increase so that the clamping force which is exerted upon the coupling element is gradually reduced. By means of the coupling region of the connecting element an indirect coupling of two adjacent turbine blades is created, which on the one hand ensures a reliable coupling in the case of twisting of the turbine blades which occurs in the non-operating state or in the operating state, and at the same time fulfills a damping function which has a positive effect on the smooth running of the turbomachine, especially of a steam turbine.

In the case of a further preferred embodiment of the invention, each connecting element has a friction/damping element which engages with two adjacent blades. The engagement in this case can be realized for example by the friction/damping element having two oppositely oriented, pin-like arms which engage in recesses, which are formed complementary to them, of two adjacent blades. In this case, the connecting element is movably supported in the recesses of the adjacent blades via the friction/damping element or its pin-like arms. This presents the great advantage that a coupling of two adjacent blades is also ensured even when the connecting element or its coupling element is no longer clamped by two adjacent turbine blades. Particularly at higher speeds, at which the blade twist corresponds to the pretwisting, the coupling element begins to separate from the two adjacent blades so that finally, upon reaching the nominal speed of the turbomachine, the coupling element is preferably freely movable between the two adjacent turbine blades.

The connecting element is expediently formed in one piece or is assembled in each case from a coupling element and a friction/damping element. A one-piece construction of the connecting element in this case reduces the logistical costs and simplifies the production process, whereas a connecting element which is assembled from coupling element and friction/damping element has the advantage that the coupling element can have different material properties from the friction/damping element and consequently an individual adaptation to special requirements is possible.

Further important features and advantages of the inventive subjects result from the dependent claims, from the drawings and from the associated figure description with reference to the drawings.

BRIEF DESCRIPTION OF THE DRAWINGS

Preferred embodiments of the invention are represented in the drawings and explained in more detail in the following description. Features which are essentially or functionally the same or similar are referred to by the same designations.

In this case, schematically in each case

DETAILED DESCRIPTION

Figure 1:
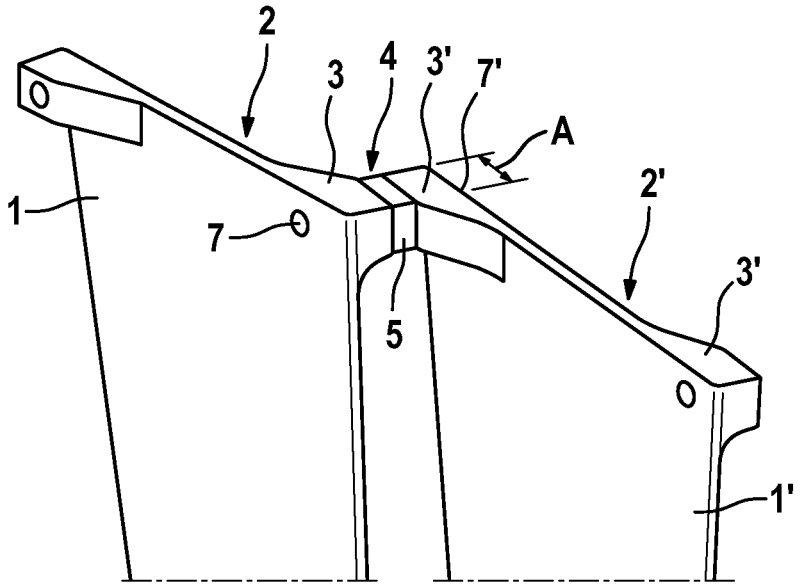
FIG. 1 shows two adjacent blades, for example of a turbine, which are interconnected via a connecting element according to the invention.

In FIG. 1, two adjacent blades 1 and 1' are shown, which for example are part of a turbine stage, which is not shown in more detail, especially of a turbine end stage, and the blades 1, 1' are turbine end blades. The two blades 1 and 1' have a sealing element 3 or 3' in each case radially at the end on the outside, that is to say in the region of the blade tip 2 or 2'. Naturally, the sealing element 3 according to FIGS. 1 to 5 only represents a possible embodiment so that it is also conceivable for the sealing element 3 to have another design, for example in the form of a cover plate.

Figure 2:
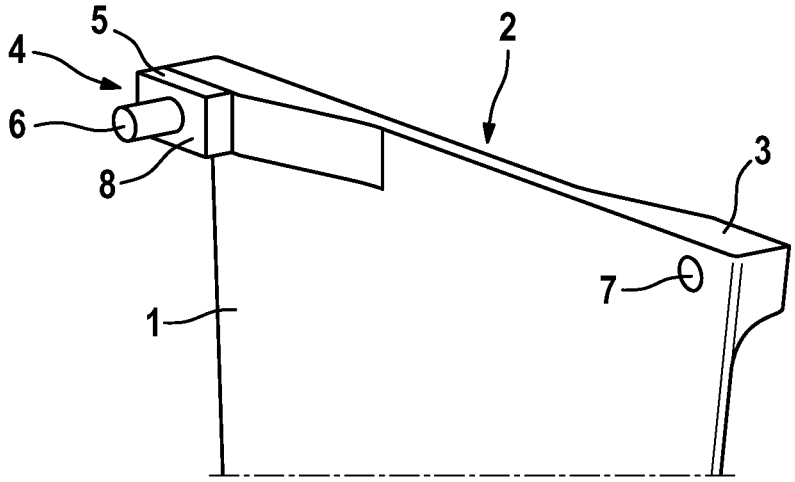
FIG. 2 shows a detailed view of the connecting element, FIGS. 3*a, b* show a connecting element in the case of differently designed blades.

According to FIG. 1, the two blades 1 and 1' overlap in the circumferential direction in a region A. In this overlapping region A, a connecting element 4, which according to FIG. 2 has a coupling element 5 and a friction/damping element 6, is arranged between the two blades 1 and 1'. In the installed state, the sealing element 3 in this case according to FIG. 1 abuts against one side of the coupling element 5, while the sealing element 3' of the adjacent blade 1' abuts on the opposite side of the coupling element 5. The friction/damping element 6 engages with the two adjacent blades 1 and 1', wherein the engagement is realized by the friction/damping element 6 engaging on one side in a complementary recess 7, for example a hole, of the first blade 1 and engaging on the other side in a complementary recess 7' of the adjacent second blade 1'. In this case, the connecting element 4 is preferably movably supported in the recesses 7, 7' of the adjacent blades 1, 1', that is to say the connecting element 4, via its friction/damping element 6 which according to FIGS. 1 and 2 for example is formed like a pin and has a preferably circular cross section, is movably supported in the axial direction of the friction/damping element 6. The friction/damping element 6 can naturally also have a different cross section, especially an elliptical or polygonal cross section. On the other hand, the coupling element 5 of the connecting element 4, as shown in FIGS. 1 and 2, can have a cuboid shape, wherein it is also conceivable for the coupling element 5 to have a cylindrical shape.

During operation of the turbomachine, the friction/damping element 6 is pressed onto a wall of the recess 7, 7' as a result of the centrifugal force so that an optimum damping effect can be controlled by means of the mass of the friction/damping element 6 or of the entire connecting element 4 since the mass has a direct effect on the contact forces which occur. Both the design of the coupling element 5 and that of the friction/damping element 6 in this case are to be only exemplarily understood according to FIGS. 1 to 5 so that in general other shapes or cross sections are also to be embraced by the inventions.

According to the invention, provision is now made to pretwist the blades 1, 1' in the non-operating state of the turbomachine in their direction of twist and to fix or interconnect them via the connecting elements 4 in such a way that the pretwisted position is maintained. When running up the turbomachine, the twisting forces are first of all reduced on account of the centrifugal force becoming stronger so that the contact forces between the coupling element 5 of the connecting element 4 and the blades 1, 1' which abut against it in each case reduce until, at a specific speed, the blade twist corresponds to the pretwisting and as a result the two blades 1 and 1' separate from the coupling element 5 in opposite directions so that ultimately, for example upon reaching the nominal speed of the turbomachine, the coupling element 5 abuts neither against the one blade 1 nor against the other blade 1'. A connection then exists only via the two pin-like arms of the friction/damping element 6 which engage in the corresponding recesses 7 and 7' of the respective blades 1 and 1'. In general, as a result of this the effect is achieved of large twists, which can customarily occur when running up the turbine, being reduced and the coupling element 5 being exposed only to the part of the twisting which was not already applied beforehand by means of the pretwisting.

As a result of the pretwisting or torsional pre-bending, according to the invention, of the blades 1, 1' of the turbomachine, the effect is achieved when reaching a nominal speed of the turbine of no direct coupling being provided between the blades 1 and 1' so that these are movable relative to each other and an indirect connection, and therefore a damping, is nevertheless provided via the connecting element 4. The pretwisting presents the advantage that when running up the turbine the blades 1, 1' first of all do not experience any twist until the speed of the turbine is high enough for the occurring twisting forces to be greater than the force applied beforehand for pretwisting. As a result of this, the twist difference which occurs between the operating state and the non-operating state of the turbine can be significantly reduced. In the non-operating state of the turbomachine, in this case the coupling element 5 of the connecting element 4 is clamped in the overlapping region A between two adjacent blades 1 and 1', wherein the pretensioning force, which acts upon the connecting element 4, is created as a result of the pretwisting of the blades 1 and 1'. In order to be able to achieve damping properties which are as good as possible in the process the connecting element is elastically formed, that is to say it can elastically absorb the loads which occur during normal operation of the turbine.

According to FIG. 3*a*, it is shown that the friction/damping element 6 of the connecting element 4 extends essentially orthogonally to an orientation of the blades 1 and 1'. In this case, contact surfaces 8 or 8', with which the respective blade 1 or 1' abuts against the coupling element 5, according to FIG. 3*a* are parallel to each other and to the blade 1. In order to be able to have an influence on a damping vibration direction, however, provision can also be made according to FIG. 3*b* for the contact surfaces 8 or 8' to extend by an angle α in an inclined manner to the blade 1. Regardless of the selected embodiment according to FIG. 3*a* or 3*b*, a connecting element 4 of the same construction can be used in the case of the two embodiments.

Figure 3:
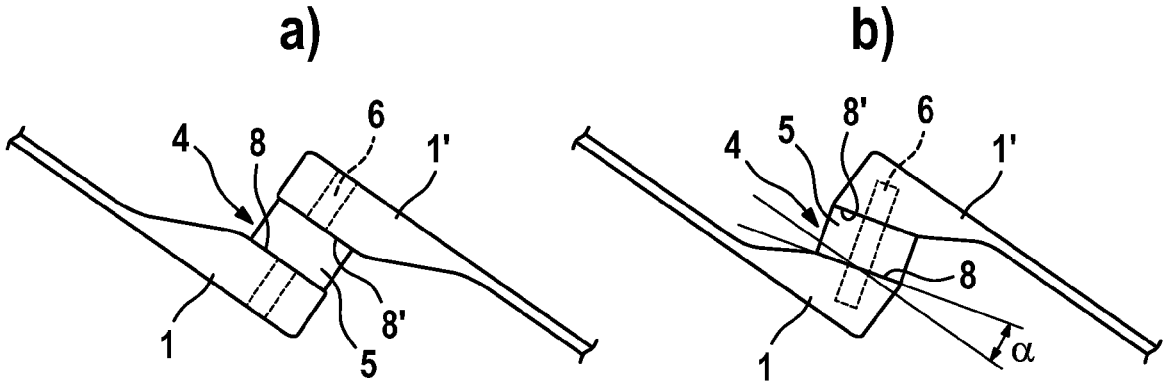
Figure 4:
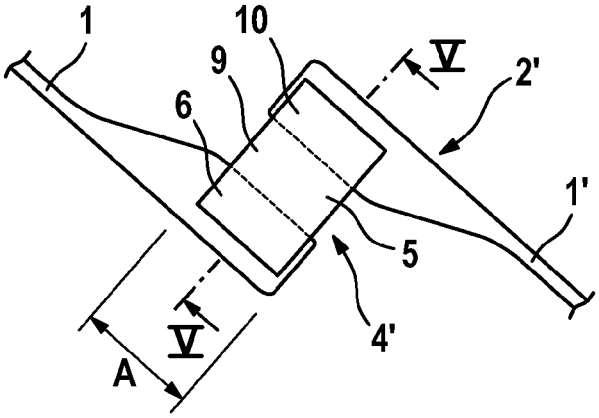
FIG. 4 shows a further embodiment of a connecting element according to the invention.
Figure 5:
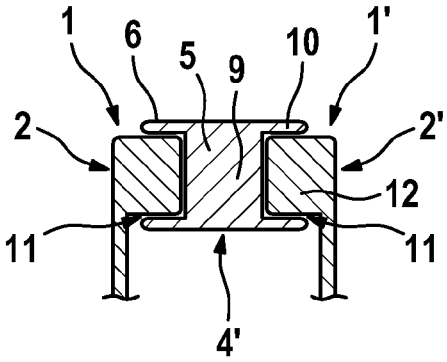
FIG. 5 shows a sectional view through two adjacent blades and a connecting element according to FIG. 4 which is arranged between them.

In contrast to FIGS. 1 to 3, the connecting element 4 can also have an H-shaped design, as shown in FIGS. 4 and 5. In this case, a center piece 9 of the H-shaped connecting element 4' is formed as a coupling element 6 while the cross-pieces 10 of the H-shaped connecting element 4' are formed as a friction/damping element 6. The arrangement of the H-shaped connecting element 4' corresponds in this case to that of the connecting element 4 which is described in FIGS. 1 to 3 so that in the case of this embodiment the two adjacent blades 1 and 1' are also pretwisted around their radial longitudinal axis so that they clamp the connecting element 4 in the overlapping region A between each other.

According to FIG. 5, the two cross-pieces 10 of the H-shaped connecting element 4' form a slot 11 for a spring 12 which is arranged at the blade tip 2 and encompass this spring in a U-like manner. A direct contact without springs is also conceivable, however. The damping function in this case is brought about via the interaction between the slot 11 and the spring 12, while the fixing of the two blades 1 and 1' in their pretwisted position is undertaken by the center piece 9, that is to say by the coupling element 5.

Regardless of the selected embodiment of the connecting element 4 according to FIGS. 1 to 5, the connecting element 4 can be formed either in one piece, that is to say from one piece, or can be assembled in each case from a coupling element 5 and a friction/damping element 6. A one-piece connecting element 4 in this case presents the advantage of lower storage and logistical costs and also of the omission of the later installation of coupling element 5 and friction/damping element 6, while in the case of a connecting element 4 which is constructed in two pieces for example different materials can be used so that the coupling element 5 can have different material or raw material properties compared with the friction/damping element 6.

For producing a connection of two adjacent blades 1 and 1' of a turbine stage, the two adjacent blades 1 and 1' are first of all pretwisted in their direction of twist which occurs in the operating state, and the connecting element 4 is then installed in the overlapping region A in such a way that the pretwisting is maintained.

LIST OF DESIGNATIONS

1 Blade
2 Blade tip
3 Sealing element
4 Connecting element
4' H-shaped connecting element
5 Coupling element
6 Friction/damping element
7 Recess
8 Contact surface
9 Center piece of the H-shaped connecting element
10 Arm
11 Slot
12 Spring
A Overlapping region
α Angle

What is claimed is:

1. A turbomachine comprising:

a turbine stage having a plurality of blades including a first and a second blade disposed adjacent to each other, each blade having a radial longitudinal axis and a blade tip capable of twisting around the radial longitudinal axis in an operating state in a twist direction, wherein the first and the second blades are pretwisted in the twist direction in a non-operating state, and wherein a connecting element interconnects the first and the second blades to each other in a circumferential direction in a region of the respective blade tip so as to maintain the pretwisting, and wherein the connecting element includes a friction/damping element engaging the first and the second blades.

2. The turbomachine as described in claim 1, wherein the first blade overlaps the second blade in the circumferential direction.

3. The turbomachine as described in claim 2, wherein the connecting element includes a coupling element disposed in an overlapping region between the first and the second blades.

4. The turbomachine as recited in claim 1, wherein the first blade includes a first recess and the second blade includes a second recess, and wherein a first side of the friction damping element engages the first recess and a second side of the friction damping element engages the second recess.

5. The turbomachine as recited in claim 1, wherein the connecting element is moveably supported in the first and the second recesses by the friction damping element.

6. The turbomachine as recited in claim 3, wherein the coupling element has a cuboid shape.

7. The turbomachine as recited in claim 6, wherein the coupling element is adapted to an adjoining region of the first and the second blades.

8. The turbomachine as recited in claim 7, wherein the connecting element includes a friction/damping element, the friction/damping element being a pin and having one of a circular and an elliptical cross section.

9. The turbomachine as recited in claim 1, wherein the connecting element is H-shaped.

10. The turbomachine as recited in claim 9, wherein the H-shaped connecting element includes a center piece formed as a coupling element.

11. The turbomachine as recited in claim 10, wherein the H-shaped connecting element includes cross-pieces formed as a friction/damping element.

12. The turbomachine as recited in claim 10, wherein the H-shaped connecting element includes cross-pieces in a form of a slot configured to encompass a spring arranged at the blade tip.

13. The turbomachine as recited in claim 2, wherein the coupling element is clamped in an overlapping region between the first and the second blades.

14. The turbomachine as recited in claim 2, wherein the connecting element is elastic.

15. The turbomachine as recited in claim 1, wherein the connecting element is formed as one piece.

16. The turbomachine as recited in claim 1, wherein the connecting element is assembled in each case from a coupling element and a friction/damping element.

17. The turbomachine as recited in claim 1, wherein the turbine stage is a turbine end stage.

18. The turbomachine as recited in claim 1, wherein the first and the second blades each include a sealing element at the blade tip.

19. A method for connecting a first and a second blade adjacent to the first blade of a turbine stage of a turbomachine comprising:

twisting the first and the second blades around a radial longitudinal axis of each blade, so that a blade tip of each of the first and the second blades is rotated to a first twist angle relative to a base of the first and the second blade; and using a connection element to couple the first and the second blades to each other in a circumferential direction in a region of the blade tip of each of the first and the second blades so as to maintain each blade tip at the first twist angle, wherein the connecting element includes a friction/damping element engaging the first and the second blades.

* * * * *